United States Patent [19]

Zusser

[11] 4,065,657

[45] Dec. 27, 1977

[54] CURLING IRON WITH STEPPED BARREL

[75] Inventor: Louis H. Zusser, Los Angeles, Calif.

[73] Assignee: Northridge Trading Company, Northridge, Calif.

[21] Appl. No.: 738,641

[22] Filed: Nov. 4, 1976

[51] Int. Cl.[2] ..... H05B 3/00; A45D 1/04

[52] U.S. Cl. ..... 219/225; 132/32 R; 132/37 R; 132/33 R; 219/230

[58] Field of Search ..... 219/222–226, 219/230, 533; 132/7, 9, 37 R, 37 A, 31 R, 32 R, 33 R, 117, 118; 38/69

[56] References Cited

U.S. PATENT DOCUMENTS

| | | | |
|---|---|---|---|
| 459,146 | 9/1891 | Nicol | 132/37 R |
| 498,986 | 6/1893 | Meyers | 132/37 R |
| 1,388,805 | 8/1921 | Dennis | 219/225 UX |
| 1,622,834 | 3/1927 | Marcel | 132/37 R |
| 2,149,318 | 3/1939 | Solomon | 132/33 R |
| 2,243,397 | 5/1941 | Schwab | 132/33 R |
| 2,458,426 | 1/1949 | Rosiello | 132/33 R |
| 3,660,634 | 5/1972 | Scott | 132/118 X |

*Primary Examiner*—A. Bartis

*Attorney, Agent, or Firm*—Kleinberg, Morganstern, Scholnick & Mann

[57] ABSTRACT

A curling iron, having a single stepped barrel having a different diameter at each step, to enable a hairdresser to perform lift operations for providing body and gentle curvature to the hair, and curl operations for curling the ends of the hair, without changing curling irons. The iron can also be effectively used to make a number of different size curls in the same strand of hair. The barrel sections of different diameter sizes are arranged substantially tangent to one another, instead of being concentric, so that the clamp which clamps hair against the barrel section can function without large steps therein which might snag on hair and also permits hair to be smoothly slid from one barrel section to the next.

7 Claims, 4 Drawing Figures

CURLING IRON WITH STEPPED BARREL

BACKGROUND OF THE INVENTION

FIELD OF THE INVENTION

This invention relates to curling irons for shaping hair.

A hairdresser commonly shapes hair by first utilizing a curling iron with a barrel of large diameter such as $\frac{3}{4}$ inch, to provide a lift or long gentle curvature to the hair which also adds to the "body" of the hair. He then typically changes to a curling iron with a barrel of smaller diameter to perform a curl operation to provide sharp curvature or curls at the end of the hair strands. In the lift operation he typically holds the curler with one hand and with the other hand winds the upper portions of a length of hair about the barrel and then pulls the barrel slowly downward along the length of the hair while allowing the wound hair to slip over the heated barrel so as to apply the same lift over the whole length of hair. Curling is done with a smaller size curling iron using either the same type of stroking operation or single settings for quite tight curls. In order to minimize the need for repeatedly changing from one size curling iron to another, the hairdresser may perform lift strokes to all or a large section of the hair of the client and then change to the smaller curling iron to perform the curl operation. However, there is still a need for a hairdresser to change curling irons and grasp and handle the clients hair many times.

SUMMARY OF THE INVENTION

In accordance with one embodiment of the present invention, a curling iron is provided which enables a person to perform multiple hair-styling operations, including lifting and curling, without changing irons and also permits these multiple operations to be performed on a single length of hair strands at only a single handling of the length of hair strands. The curling iron includes a single barrel having plurality of barrel sections of different diameters and a clamp with a plurality of clamp portions of different diameters for closely nesting about the different barrel sections. The barrel sections are preferably arranged with their peripheries tangent to one another, instead of coaxial, so that the clamp portions can be formed with minimal discontinuities between them that could snag on hair and also to permit hair to be smoothly slid from one barrel section to the next for further processing. In an iron with two barrel sections, wherein the small barrel section has approximately half the cross-sectional area of the large one, a heating element is provided which has a single loop in the small barrel section and a double loop in the large barrel section so that the amount of heating is about proportional to the volume.

DESCRIPTION OF THE PREFERRED EMBODIMENTS

Figure 1:
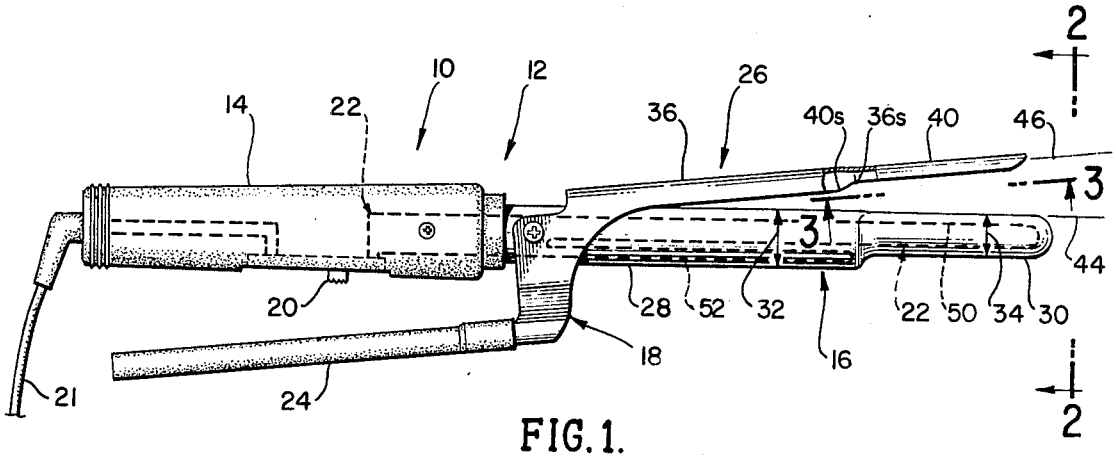
FIG. 1 is a side elevation view of a curling iron constructed in accordance with the present invention, with the clamp device in a partially unclamped position.
Figure 2:
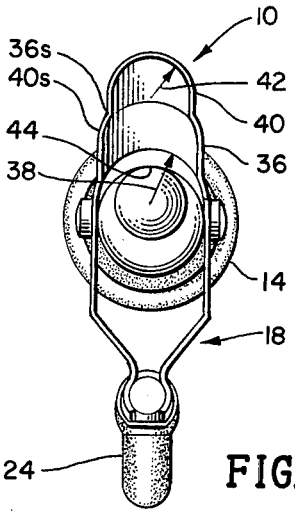
FIG. 2 is a view taken on the line 2—2 of FIG. 1.
Figure 3:
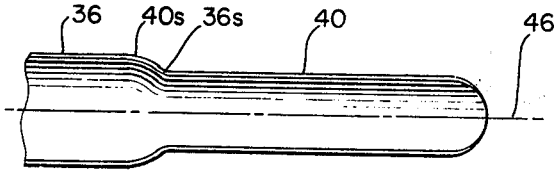
FIG. 3 is a view taken on the line 3—3 of FIG. 1.

FIGS. 1–3 illustrate a curling iron 10 which can be used by a hairdresser to curl the hair of a client. The iron includes a body 12 with a handle 14 at one end and a barrel apparatus 16 at the other end, and includes a clamping device 18 pivotally mounted on the body. When the hairdresser or other user turns on a switch 20, current from a wire 21 which is plugged into a wall outlet (not shown) flows through a resistance heating element 22 in the barrel apparatus to heat it. The hairdresser utilizes the iron by moving a clamp handle 24 away from the body handle 14 so that a clamping end 26 moves away from the barrel apparatus 16, then winds a quantity of hair about the barrel apparatus, and causes the clamp end 26 to gently clamp the hair against the barrel apparatus 16 as he pulls the hair out.

Hair is typically shaped to provide a long gentle curve along most of the hair length, and to provide considerably more curvature at the end. This is ordinarily performed by the use of several curling irons with barrels of different diameters, the larger diameter being best for providing a long gentle curl while adding body to the hair, and a barrel of smaller diameter being useful for generating sharper curls. In accordance with the present invention, the stepped barrel or barrel apparatus 16 is constructed with a plurality of barrel sections of different diameters, the particular iron illustrated in FIGS. 1–3 having two barrel sections 28, 30. The large barrel section 28, which has a diameter 32 of $\frac{3}{4}$ inch, extends from the forward end of the handle 14. The smaller barrel section of a diameter 34 of $\frac{1}{2}$ inch, extends from the forward end of the large barrel. The clamp end 26 of the clamping device, is correspondingly formed, with one clamping portion 36, which lies adjacent to large barrel section 28, having an inside radius of curvature 38 of approximately $\frac{3}{8}$ inch (to lie on the $\frac{3}{4}$ inch barrel). Another clamping portion 40 which lies adjacent to the small barrel section 30, has an inside radius of curvature 42 of $\frac{1}{4}$ inch. Both clamping portions extend much less than 180° about their respective barrel sections. Thus, when the clamping end 26 of the clamping device moves against the barrel apparatus 16, both clamping portions 36, 40 nest closely against the corresponding barrel sections 28, 30. When a hairdresser utilizes the curling iron 10, he can perform a lift along most of a single length of hair strands by utilizing the large barrel section 28 around which he winds the upper portions of the lengths of hair. When he reaches the end portions of the hair, he can form a curl by winding the end portions of the length of hair around the smaller barrel section 30, all without changing curling irons or picking up the hair more than once. Also, hair which has already been given a general lift on the large barrel section can be further curled by sliding portions of it over to the small barrel section and winding it thereabout. The practitioner has complete freedom to lift or curl any portion of a hair length by processing it on one or both of the barrel sections. Thus, the practitioner can also simultaneously or sequentially make a large diameter curl on one portion of a hair length and a small diameter curl on another portion of the same hair length.

Although the stepped barrel apparatus 16 and stepped clamp end 26 can facilitate the performance of two hair-forming operations, they give rise to the possibility of snagging of the hair. Such snagging can occur at the step where the two barrel sections meet, and especially at the step where the two clamping portions 36, 40 meet. To minimize the possibility of such snagging, the two barrel sections 28, 30 are constructed so that, instead of being concentric, they lie approximately tangent to one another along a tangent line 44. The line 44 also lies adjacent to the center of the clamp end 26 when the clamping device is closed. The clamp portions 36, 40, are also formed so that their center lines lie approximately tangent to one another along another imaginary line 46. It may be noted that for ease of manufacture, there may be some slight offsetting of the two barrel sections and of the two clamping portions, from tangency, as illustrated. When the clamp end 26 moves against the barrel apparatus 16, the two tangent lines 44, 46 lie substantially against one another. Although there are appreciable steps between the sides 36*s*, 40*s* of the clamp portions at their intersection, these are relatively small steps so that sharp discontinuities can be easily avoided through gentle curving thereat.

The resistance heating element 22 is a simple wire for generating heat. The wire element is positioned so that it extends in a first loop 50 that extends along most of the length of both barrel sections 28, 30, and in a second loop 52 that extends along most of the length of only the large barrel section 28. This provides more heating for the large barrel section to account for the greater amount of heat required to heat it to operating temperatures.

Figure 4:
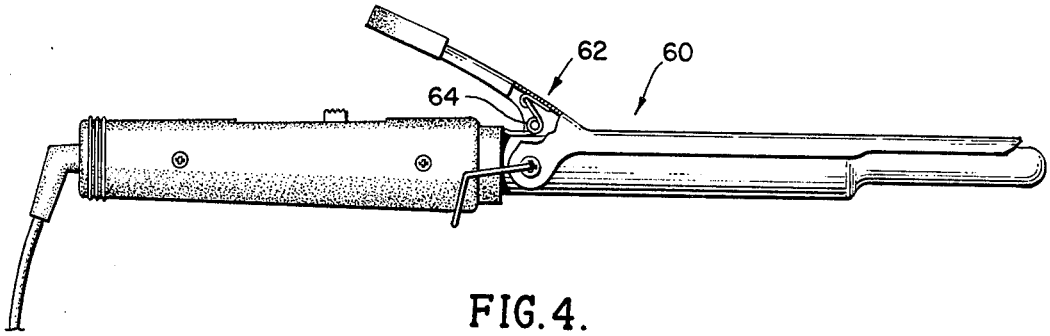
FIG. 4 is a side evaluation view of a curling iron constructed in accordance with another embodiment of the invention, with the clamp device in a fully closed position.

Curling irons of the present invention can be constructed in a variety of designs. FIG. 4 illustrates another curling iron 60 designed primarily for home use, where the operator may have less skill. The iron 60 is similar to that of FIG. 1, except that it includes a clamping device 62 which is biased by a spring 64 towards a closed position. In order to permit even more closely controlled hairstyling, more than two barrel sections of different diameters can be provided. For example, where sharp curls are desired, professional hairdressers sometimes utilize an iron with a very small barrel. Such a small barrel section can be added to extend from the forward end of the barrel section 30 in FIG. 1.

Thus, the invention provides a curling iron which enables the forming of hair to different degrees of curling, in an accurate manner, utilizing only a single curling iron. This is accomplished by providing a plurality of barrel sections of different diameters spaced along the length of the barrel apparatus, together with corresponding clamping portions. The barrel sections are positioned substantially tangent to one another, to provide a region between the barrel sections with substantially no step, and to enable a clamp to be utilized which has minimal steps. A simple heating means is provided by utilizing a resistance heating element that extends in a single loop through a small diameter barrel section and in a double loop in a larger diameter barrel section.

Although particular embodiments of the invention have been described and illustrated herein, it is recognized that modifications and variations may readily occur to those skilled in the art and consequently it is intended that the claims be interpreted to cover such modifications and equivalents.

I claim:

1. A curling iron comprising:

a body having a handle at one end and an elongated stepped barrel apparatus at the other end;

a heating element in said stepped barrel apparatus; and a clamp device pivotally mounted on said body, said device having a handle at one end near said body handle and a clamping apparatus near said stepped barrel apparatus;

said stepped barrel apparatus having a small plurality of discrete barrel sections each of substantially different diameter spaced along its length, the barrel section closest said handle having the largest diameter and each successive barrel section having a successively smaller diameter, and said clamping apparatus extending along the length of said stepped barrel apparatus to overlay at least a portion of each barrel section.

2. The curling iron of claim 1 wherein said clamping apparatus has a plurality of clamp portions extending along the length of said stepped barrel apparatus, each clamp portion being concavely curved to match the curvature of an adjacent barrel section to rest closely thereabout.

3. The curling iron described in claim 2 wherein:

each pair of adjacent barrel sections of different diameters lie approximately tangent to one another along a predetermined line which is overlaid by said clamping apparatus and said clamping portions are approximately tangent to one another along a second line substantially coincidental with said predetermined line when said clamping portions are moved against said barrel sections, whereby to minimize the unwanted catching of hair strands.

4. The curling iron described in claim 1 wherein:

said stepped barrel apparatus includes a first barrel section of a first cross-sectional area, and a second barrel section adjacent to said first barrel section and having a second cross-sectional area approximately one-half as great as said first area; and said heating element extends in a first loop that passes through the length of said first and second barrel sections and back through the lengths of said second and first barrel sections, and also extends in a second loop that passes through the length of only said first barrel section and back through the length of said first barrel section.

5. The curling iron described in claim 1 wherein:

said heating element extends through each barrel section and is constructed to apply heat per unit length to each barrel section which is approximately proportional in magnitude to the cross-sectional area of each barrel section.

6. A curling iron for curling hair, comprising:

a body handle having forward and rearward ends;

a stepped barrel apparatus including a first barrel section of first diameter extending forwardly from said forward end of said body handle and further including a second barrel section of a second diameter smaller than said first diameter, extending forwardly from the forward end of said first barrel section, the surface of said second barrel section being substantially tangent to the surface of said first barrel section along an imaginary first tangent line;

a clamp apparatus with handle and clamping ends, said clamp apparatus pivotally mounted to said first barrel section near the rearward end of said first barrel section so that said clamping end can move against and away from said barrel section, said clamping end having a first clamp portion which can lie against said first barrel section and which has an inside surface concavely curved to nest against said first barrel section and extend less than 180° thereabout, and said clamping end having a second portion which can lie adjacent to said second barrel section and which has an inside surface concavely curved to nest against said second barrel section and extend less than 180° thereabout, said first and second clamp portions being substantially tangent to each other along an imaginary second tangent line which is substantially coincident with said first tangent line when said clamping end moves against said barrel sections; and a heating element means in said stepped barrel apparatus.

7. The curling iron described in claim 6 wherein:

said first barrel section has a circular periphery of approximately $\frac{3}{4}$ inch diameter, said second barrel section has a circular periphery of approximately $\frac{1}{2}$ inch diameter, and said heating element means extends through said barrel sections and is constructed to apply approximately twice as much heat per unit length to said first barrel section as to said second barrel section.

* * * * *